US006588600B1

(12) United States Patent
Herborn

(10) Patent No.: US 6,588,600 B1
(45) Date of Patent: Jul. 8, 2003

(54) METHOD AND DEVICE FOR SORTING FLUORESCENT LAMPS

(76) Inventor: Paul Herborn, Nonnenwaldweg 3, D-65388 Schlangenbad-Georgenborn (DE)

( * ) Notice: Subject to any disclaimer, the term of this patent is extended or adjusted under 35 U.S.C. 154(b) by 0 days.

(21) Appl. No.: 09/830,771

(22) PCT Filed: Oct. 20, 1999

(86) PCT No.: PCT/EP99/07975

§ 371 (c)(1),
(2), (4) Date: Aug. 20, 2001

(87) PCT Pub. No.: WO00/25946

PCT Pub. Date: May 11, 2000

(30) Foreign Application Priority Data

Oct. 30, 1998 (DE) ..... 198 50 285

(51) Int. Cl.[7] ..... B07C 5/14
(52) U.S. Cl. ..... 209/518; 209/538; 209/583
(58) Field of Search ..... 209/517, 518, 209/538, 577, 583, 939

(56) References Cited

U.S. PATENT DOCUMENTS 3,749,241 A * 7/1973 Matsuzaki et al. ..... 209/518
4,587,407 A 5/1986 Ahmed et al. ..... 235/467
4,919,274 A 4/1990 Hammond ..... 209/583
5,292,007 A * 3/1994 Beer et al. ..... 209/518
5,366,096 A * 11/1994 Miller ..... 209/538 X

FOREIGN PATENT DOCUMENTS

DE 263714 * 1/1989 ..... 209/518
DE 43 02 008 A1 1/1993
DE 44 01 351 A1 1/1994

* cited by examiner

*Primary Examiner*—Tuan N. Nguyen

(57) ABSTRACT

A method and a device for sorting, in terms of phosphor blends, fluorescent lamps, which have a cylindrical body with a right-hand and left-hand end and with a symbol overprint. The fluorescent lamps that are conveyed into an inspection station which have a stop for defining an inspection plane, against which the lamp body respectively to be examined bears. A camera to which an image processing system is connected is directed onto the symbol overprint of the lamp body respectively to be examined. A rotating device in the inspection station is started up in order to rotate the lamp body respectively to be examined. The camera outputs pixel signals to the image processing system, which obtains image data from the pixel signals. The image processing system contains image memories with data for input symbols, and an image-comparing device which correlates the image data with the input symbol data. The respectively examined fluorescent lamp is conveyed out of the inspection station and directed into one of a plurality of sorting cracks via a switching system.

11 Claims, 2 Drawing Sheets

METHOD AND DEVICE FOR SORTING FLUORESCENT LAMPS

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to a method and a device for sorting fluorescent lamps in terms of phosphor blends.

It is important to recover the phosphor when recycling fluorescent lamps. However, the various manufacturers of fluorescent lamps use different additives to the basic phosphor, and this renders the recovery of the basic phosphor extremely difficult.

In order to avoid these difficulties, the inventor has developed a concept of desiring to recover not the phosphor as such, but the phosphor blends as they occur in the various types of lamp of the various manufacturers.

SUMMARY OF THE INVENTION

It is therefore the object of the invention to create a method and device for sorting fluorescent lamps which are such as to permit sorting in terms of phosphor blends.

The object set is achieved on the basis of the following method steps:

a) providing an inspection station with an image processing system having an image memory for recording symbol data relating to symbol imprints from different manufacturers, the image processing system also having a converter for converting pixel signals into actual image data and for comparing the actual image data with the recorded symbol data;

b) conveying the lamps into the inspection station having a stop for defining an inspection plane, each lamp body to be examined engaging the inspection plane;

c) directing at least one camera to which the image processing system is connected onto an assigned of of the right-hand and left-hand end of each lamp body to be examined with the symbol imprint thereon;

d) rotating each lamp body to be examined in the inspection station while the camera is directed onto the symbol imprint;

e) outputting pixel signals from the camera to the image processing system and obtaining the actual image data from the pixel signals;

f) correlating the actual image data with the recorded symbol data for producing a control signal indicative of the symbol imprint which is present on the lamp under inspection; and g) conveying each inspected lamp out of the inspection station and directing same into one of a plurality of sorting paths via a switching system which is controlled by the control signal; and a device having the following features:

an intake conveying path for fluorescent lamps on which a stop surface for the lamp bodies is provided, in order to define an inspection plane, the ends of the lamp bodies remaining free from the stop surface;

a rotating device for the respectively bearing lamp body;

at least one camera, whose image plane is aligned with the inspection plane in the region of one of the ends of the lamp body;

an image processing system which is connected to the at least one camera in order to obtain image data from pixel signals and which, furthermore, contains image memories with data for input symbols and has an image processing device which correlates the image data with the input symbol data; and an outlet conveying path with a controllable switching system which is connected to the inspection station and can be controlled by the image processing systems and is defined and further developed by the further measures of the invention.

In detail, the fluorescent lamps to be sorted are fed to an inspection station such that they are at a predetermined distance from at least one camera. Each fluorescent lamp is rotated in order to read the overprint located in the vicinity of the lamp foot and feed it to an image processing system. The overprint generally contains a company logo with a type identification composed of letters and numerals. The image processing system contains a memory for data recordal from such company logos and type identifications, so that the respectively examined fluorescent tube can be assigned to the manufacturer and the type of lamp by means of comparison. This renders it possible to sort the fluorescent lamps with regard to their phosphor blends.

In the case of fluorescent lamps, the overprint is always located only at one end in a region of approximately 80 mm width from the end of the lamp body. If used fluorescent lamps are delivered, the distribution of the ends with an overprint or without an overprint is arbitrary. In order to tackle this problem, it is possible to provide a double pass through the detection system, a previously undetected fluorescent lamp being rotated by 1800 before the second pass, such that its correct end passes by the camera.

However, it is also possible to provide two cameras which are each directed onto an assigned end of the lamp body. In this configuration of the invention, one of the cameras is of movable design in order to be able to adapt to the different lengths of fluorescent tubes, which can be of length in the region of between 350 and 1800 mm.

Use may be made for the purpose of supporting the lamps in the inspection station of two angles which are arranged at a distance from one another and whose connecting lines together produce an aligning prism. The supporting angles are to be arranged at a satisfactory distance from the ends of the fluorescent lamps, in order not to disturb the image inspection by the cameras, one of the supporting angles is of movable configuration in order to be able to adapt to the specified length range of from 350 to 1800 mm of the fluorescent lamps.

BRIEF DESCRIPTION OF THE DRAWINGS

Details of the invention are explained with the aid of the drawing, in which.

DETAILED DESCRIPTION OF THE INVENTION

Figure 1:
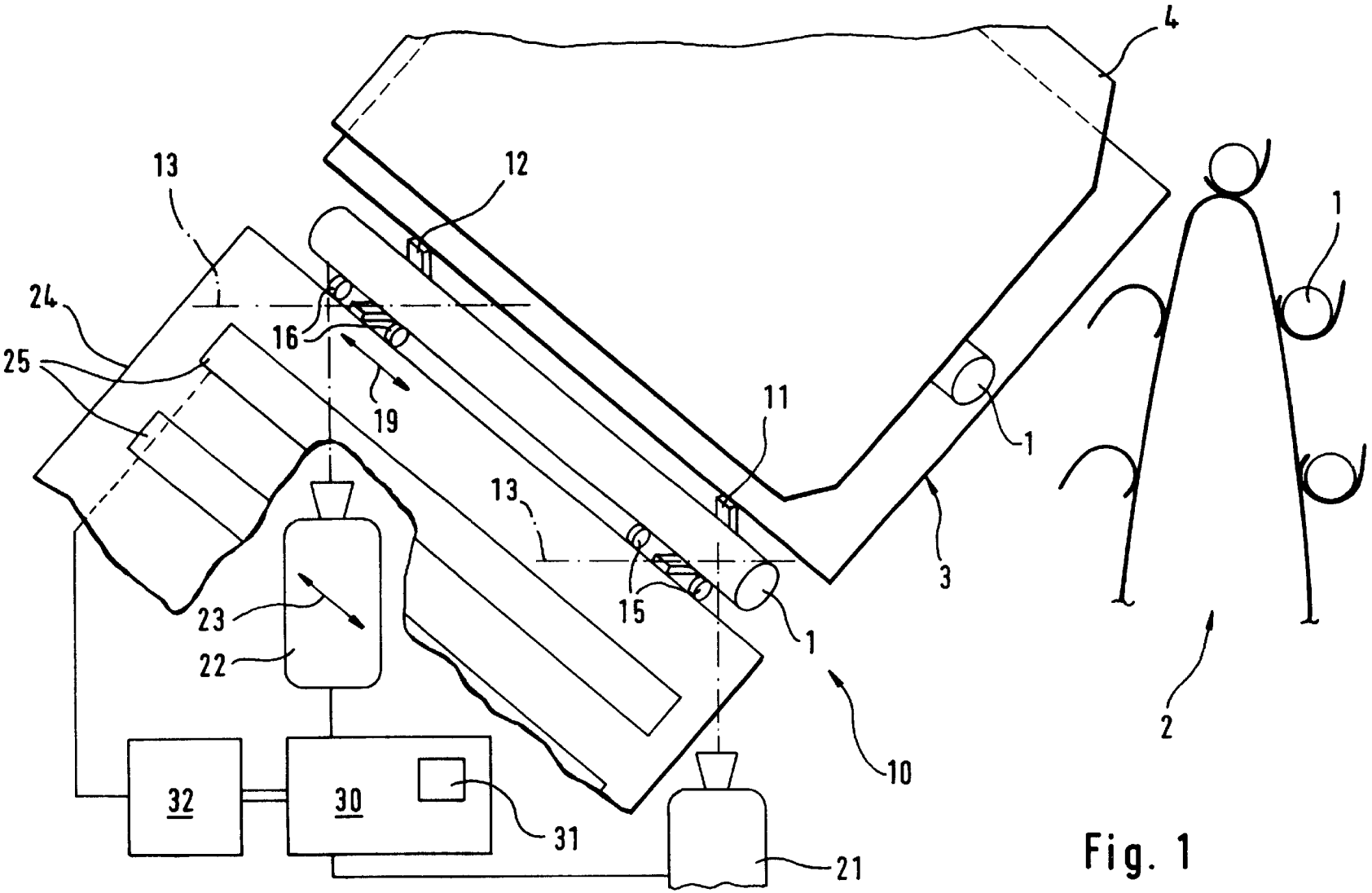
FIG. 1 shows a schematic overall view.

Fluorescent lamps 1 are transported individually by a bucket conveyor 2 to an intake conveying path 3 which comprises an inclined raceway. A guiding top surface 4 ensures that the fluorescent tubes 1 arrive in an inspection station 10 in a horizontally aligned fashion. Provided in the inspection station 10 are stops 11 and 12 which are designed in the present case as stop angles and define a prism in conjunction with one another in order to hold the lamp body of the fluorescent tube 1 at a defined distance from a right-hand camera 21 or a left-hand camera 22. The prism defined by the angle stops 11 and 12 includes two mutually perpendicular faces of which each can be used as an inspection plane assigned to the cameras 21 or 22, respectively. In the illustrated exemplary embodiment, the stop surface 13 at a steeper angle to the roll surface 3 is to be used as inspection plane. Consequently, the viewing directions of the cameras 21 and 22 are aligned perpendicularly to this plane 13, and the distance of the cameras is selected such that the plane 13 is sharply imaged in the camera.

Figure 2:
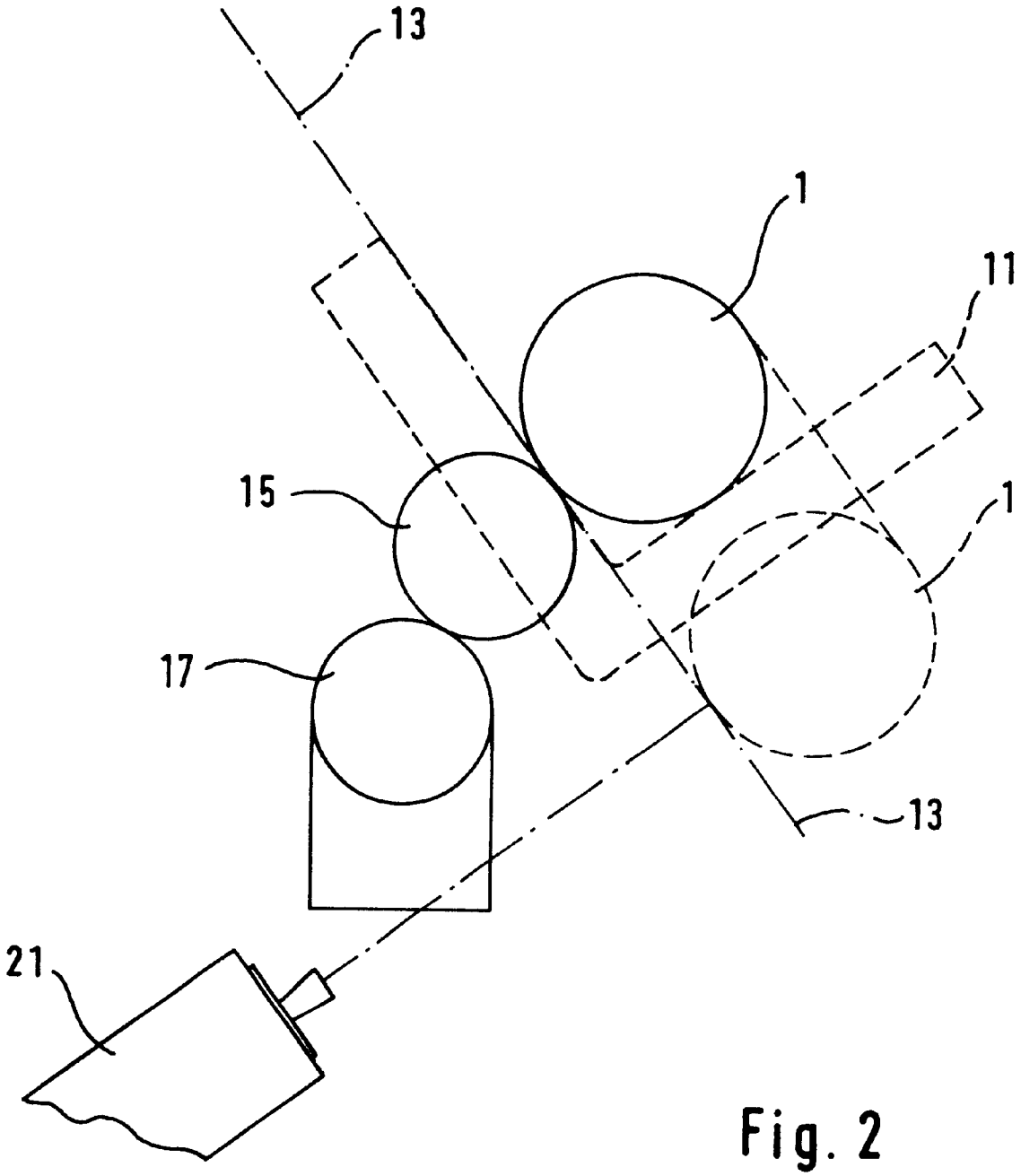
FIG. 2 shows an enlarged detail from FIG. 1.

Assigned to each stop angle 11 or 12 are pairs of rolls 15 and 16, respectively, which are arranged at a tangent to the stop plane 13, as is best illustrated in FIG. 2. The rolls 15 or 16 is respectively assigned a friction roll drive 17 or 18, in order to drive the respective roll 15 or 16, and thus to rotate the lamp body 1 located in the inspection station.

The stop angle 11 and the assigned rolls 15 are 30 arranged in a stationary fashion, while the stop angle 12 together with its rolls 16 can be moved in the direction in which the inspection station 10 extends, as is indicated by the double arrow 19. The displacement of the stop angle 12 together with the rolls 16 can be performed by means of a spindle and a guide, this not being illustrated for reasons of clarity.

In the same way as the stop angle 12 can be displaced, the camera 22 can also be displaced parallel to the longitudinal extent of the inspection station 10, as is indicated by the arrow 23. A spindle and guide can be used for this purpose; other means of displacement can also be used. The displacement of the stop angle 12 and the camera 22 allows the device to be adapted to changing lengths of the lamp bodies 1. When the device is designed for a maximum length of the lamp bodies 1 of 1800 mm, the stop angle 11 is located at a distance of approximately 150 mm from the end of the lamp body 1. The movable stop angle 12 can be moved up to 15*a* distance of 150 mm from the end of the lamp body 1. If shorter lamps are present for checking, the movable stop angle is moved to the right in the drawing, in order to leave free approximately 150 mm to the end of the lamp body. The camera 21 is arranged in a stationary fashion and aligned with an end region of the lamp body 1 which is of width 80 mm and on which the manufacturer's overprint with manufacturer's symbol and type identification is to be expected. The movable camera 22 is directed onto the respective end of the lamp body 1, specifically onto a region of likewise 80 mm. width.

The two cameras 21 and 22 are connected to an image processing system 30 which can pick up digital image information coming from the cameras as pixel signals and compare it to stored image information. This stored image information relates to the overprints to be expected at the end of the lamp body, specifically as regards manufacturer and type of lamp. In general, company symbols or logos and letter/numeral combinations are overprinted, the size of the overprint depending on the type of lamp, when the lamp body 1 is rotated during checking, and the overprint moves through the visual field of the camera 21, the company logo and the type identification are read off in the sequence to which we are accustomed. If, by contrast, the symbol overprint is located at the left-hand end of the lamp body, the camera 22 reads the symbol overprint backwards. This is taken into account during processing in the image processing system. If the image processing system has a monitor 31 for monitoring purposes, then said monitor is fed such that the overprint appears in the correct reading direction for a person.

Connected to the image processing system 30 is a switching controller 32 which ensures that the lamp body respectively checked is correctly sorted. This is performed in an outlet conveying path 24, which can be designed as an inclined raceway with a row of flaps 25. By reversing the rolls 15 and 16, the lamp body respectively located in the inspection station 10 is raised above the height of the stop angle 11 and 12 and then reaches the raceway 24 and rolls downward thereupon. Each flap 25 has a flap drive which is respectively connected to the switching controller 32. The switching controller 32 has as many outputs as there are phosphor blends plus a further output for non-identified phosphor blends. The flaps 25 are assigned to the respective outputs of the switching controller 32, such that upon the detection of a specific class of fluorescent tubes by manufacturer and type of lamp or types of lamp, to which a specific phosphor blend is assigned, an assigned flap 25 is opened and the downward rolling fluorescent tube lands in a container located therebelow.

The new sorting method permits relatively quick detection of the class of the fluorescent tube under examination. It is possible to contemplate cycle times from 2 seconds to 0.5 seconds. The selectivity of the detection of the symbol overprint is very high, "symbol overprint" being understood both as the company logo and as the type identification. Lamps whose classification cannot be unambiguously detected are processed in the previously customary way. In this way, the phosphor blends recovered from the fluorescent tubes are recovered with a quality which is extremely high since it is not impaired by admixtures. The phosphor blends are obtained from the fluorescent tubes in the usual manner by opening the fluorescent tubes and blowing out the coating with compressed air.

What is claimed is:

1. A method for sorting, in terms of phosphor blends, fluorescent lamps which have a cylindrical lamp body with a right-hand and left-hand end and with a symbol imprint characteristic of a specific manufacturer and type of lamp, comprising the steps of:

a) providing an inspection station with an image processing system having an image memory for recording symbol data relating to symbol imprints from different manufacturers, said image processing system also having a converter for converting pixel signals into actual image data and for comparing said actual image data with said recorded symbol data;

b) conveying said lamps into said inspection station having, a stop for defining an inspection plane, each lamp body to be examined engaging said inspection plane;

c) directing at least one camera to which said image processing system is connected onto an assigned one of said right-hand and left-hand end of each lamp body to be examined with said symbol imprint thereon;

d) rotating each lamp body to be examined in the inspection station while said camera is directed onto said symbol imprint;

e) outputting pixel signals from the camera to the image processing system and obtaining said actual image data from said pixel signals;

f) correlating said actual image data with said recorded symbol data for producing a control signal indicative of the symbol imprint which is present on the lamp under inspection; and g) conveying each inspected lamp out of the inspection station and directing same into one of a plurality of sorting paths via a switching system which is controlled by said control signal.

2. The method as claimed in claim 1, characterized in that the fluorescent lamps are conveyed in a horizontal alignment of their bodies (1), and in that the fluorescent lamps run into an angular prism as stop means (11, 12).

3. A device for carrying out the method as claimed in claim 1, having the following features:

an intake conveying path (3) for fluorescent lamps on which a stop surface (13) for the lamp bodies (1) is provided, in order to define an inspection plane, the ends of the lamp bodies (1) remaining free from the stop surface;

a rotating device for the respectively bearing lamp body;

at least one camera (21), whose image plane is aligned with the inspection plane (13) in the region of one of the ends of the lamp body (1);

an image processing system (30) which is connected to the at least one camera (21) in order to obtain image data from pixel signals and which, furthermore, contains image memories with data for input symbols and has an image processing device which correlates the image data with the input symbol data; and an outlet conveying path (24) with a controllable switching system (25) which is connected to the inspection station (10) and can be controlled by the image processing systems (30, 32).

4. The device as claimed in claim 3, characterized in that one of the cameras (22) can be moved parallel to the inspection plane (13) in order to adapt to different lengths of the lamp body (1).

5. The device as claimed in claim 4, characterized in that the intake path (3) is designed as an inclined surface at whose lower end two stop angles (11, 12) are located which are arranged at a prescribed spacing from the right-hand or left-hand end, respectively, of the lamp body (1) and define a prismatic body in connection with one another.

6. The device as claimed in claim 5, characterized in that one holding angle (11) is stationary and the other holding angle (12) can be moved along the prismatic body in order to adapt the support of the lamp body (1) to different lengths of the lamp body.

7. The device as claimed in claim 4 characterized in that one of the cameras (22) can be moved parallel to the inspection plane (13) in order to adapt to the different lengths of the lamp body (1).

8. The device as claimed in claim 5, characterized in that one of the cameras (22) can be moved parallel to the inspection plane (13) in order to adapt to the different lengths of the lamp body (1).

9. The device as claimed in claim 6 characterized in that one of the cameras (22) can be moved parallel to the inspection plane (13) in order to adapt to the different lengths of the lamp body (1).

10. The device as claimed in claim 1, characterized by moving the camera along the lamp body.

11. The device as claimed in claim 1, rotating the lamp by 180 degrees and reentering the lamp into the inspection station.

* * * * *